US005507106A

United States Patent [19]

Fox

[11] Patent Number: 5,507,106

[45] Date of Patent: Apr. 16, 1996

[54] EXERCISE SHOE WITH FORWARD AND REARWARD ANGLED SECTIONS

[76] Inventor: Marcus Fox, 170 Old Canton Rd., Ball Ground, Ga. 30107

[21] Appl. No.: 261,852

[22] Filed: Jun. 17, 1994

Related U.S. Application Data

[63] Continuation-in-part of Ser. No. 76,034, Jun. 18, 1993, abandoned.

[51] Int. Cl.[6] ..... A43B 13/00

[52] U.S. Cl. ..... 36/103; 36/114; 36/110

[58] Field of Search ..... 36/103, 134, 135, 36/25 R, 91, 106, 112, 114, 81, 169, 110, 33, 11.5, 31; 602/3, 23, 27, 10

[56] References Cited

U.S. PATENT DOCUMENTS

| | | | |
|---|---|---|---|
| 2,278,626 | 4/1942 | Vasko | 36/8.5 |
| 2,884,717 | 5/1959 | Goldberg | 36/8.5 |
| 3,006,085 | 10/1961 | Bingham, Jr. | 36/59 |
| 3,859,727 | 1/1975 | Nakamoto | 36/11.5 |
| 4,155,180 | 5/1979 | Phillips | 36/129 |
| 4,206,558 | 6/1980 | Bivona | 36/7.5 |
| 4,372,059 | 2/1983 | Ambrose | 36/32 |
| 4,425,721 | 1/1984 | Spronken | 36/11.5 |
| 4,589,216 | 5/1986 | Fuscone | 36/32 |
| 4,631,842 | 12/1986 | Koskela | 36/1.3 |
| 4,811,504 | 3/1989 | Bunke | 36/132 |
| 4,989,349 | 2/1991 | Ellis | 36/25 |
| 5,088,481 | 2/1992 | Darby | 602/23 |

FOREIGN PATENT DOCUMENTS

| | | | |
|---|---|---|---|
| 1533522 | 7/1967 | France . | |
| 7024395 | 2/1972 | France | A43B 7/00 |
| 2511850 | 3/1982 | France | 36/114 |
| 2136267 | 9/1984 | United Kingdom | A43B 13/37 |

*Primary Examiner*—Thomas P. Hilliard
*Attorney, Agent, or Firm*—Hopkins & Thomas

[57] ABSTRACT

An athletic shoe having a shoe body including a shoe upper, a heel portion, a toe portion, and a sole member mounted to the shoe body extending from the heel to the toe of the shoe body. The bottom of the sole member is covered with ground contacting sole to provide proper traction, and includes a first angle portion below the heel of the shoe body, a second angle portion below the toe of the shoe body, and a platform section therebetween.

5 Claims, 2 Drawing Sheets

EXERCISE SHOE WITH FORWARD AND REARWARD ANGLED SECTIONS

CROSS REFERENCE TO RELATED INVENTION

This application is a continuation-in-part of U.S. patent application Ser. No. 08/076,034 filed Jun. 18, 1993, now abandoned.

FIELD OF THE INVENTION

The present invention generally relates to exercise shoes. In particular, the present invention relates to a shoe for the exercising and stretching of the muscles, ligaments, and tendons of the legs, ankles, and feet of a wearer and for aligning the feet and legs of the wearer during exercising in order to strengthen the muscles, ligaments.

BACKGROUND OF THE INVENTION

In today's health conscious society, exercise and participation in sports have become increasingly popular activities. However, as interest and activity in exercising and participation in sports has increased, so have sports injuries. In particular, leg and back injuries due to overexertion, strain, or contact during exercise and sporting contests have increased. Additionally, rehabilitation and physical therapy for the handicapped has become a field of growing concern for the greater health of handicapped persons. As a result, sports medicine and rehabilitative therapy have become fields of increased interest, with rehabilitation techniques being developed which concentrate on stretching and exercising a particular injured area, such as a knee, ankle, or foot. Such rehabilitative and therapeutic techniques are specifically designed to strengthen and rehabilitate injured joints and limbs and/or to aid in increasing the mobility and self-sufficiency of the handicapped.

As an aid to physical therapy and rehabilitation techniques for back, leg, foot, and ankle injuries, a number of specialized therapeutic aids such as braces or splints have been developed. In particular, special orthopedic or exercise shoes have been developed that are designed to immobilize or protect the feet, ankles, and/or joints of a wearer during exercise. These shoes protect the muscles, ligaments, and tendons between the feet, ankles, and legs from being subjected to additional stresses and possible additional injuries during rehabilitation/strengthening exercises.

For example, U.S. Pat. No. 5,088,481 of Darby discloses a boot designed to fit around a lightweight cast about the ankle and foot of a patient. The boot of Darby is designed to immobilize the foot of the patient. As the patient walks, the foot is moved through a smooth gait so as to prevent the muscles, ligaments, and tendons from being subjected to stresses and strains during a normal walking motion. U.S. Pat. Nos. 4,631,842 and 4,589,216 of Koskela and Fuscone, respectively, each disclose sole elements for athletic shoes that are designed to reduce muscular strain or stress placed on the muscles and tendons between the feet and legs of the wearer during exercise.

Thus, most conventional rehabilitative shoes or sole elements generally are directed to protecting certain ones of the muscles, ligaments, and tendons from being subjected to stresses or stretching. Such stresses would tend to work these particular muscles, ligaments, and tendons thereby strengthening them. However, conventional rehabilitative shoes such as those discussed in the foregoing fail to strengthen and develop all of the foot and leg muscles, ligaments, and tendons equally for a complete rehabilitative benefit, but, instead, are directed to relieving the stress necessary for such development.

Accordingly, it can be seen that a need exists for an exercise or orthopedic shoe that stresses and exercises the muscles, ligaments, and tendons between the feet and legs of wearers during all ranges of motion for strengthening and rehabilitating substantially all of the muscles and tendons in the legs, angles, and feet.

SUMMARY OF THE INVENTION

In general, the present invention comprises an exercise shoe for exercising and strengthening the muscles, ligaments, and tendons between the feet and legs of a wearer. The exercise shoe is designed for exercising the feet and legs of a wearer while walking, standing, and/or sitting. The exercise shoe includes a shoe body formed from leather, canvas, cloth, or similar material which is adapted to receive and enclose the foot of a wearer. The shoe body includes a shoe upper and a tongue, a first or rear end, at which is formed the heel of the shoe, a second or front end spaced from the heel end at which is formed the toe of the shoe, and a bottom surface. The bottom surface of the shoe body is configured to fit, as an approximation, the shape and configuration of the foot of a wearer and has an instep portion formed adjacent the heel of the shoe.

A sole member is attached to the bottom surface of the shoe body on the exterior thereof. The sole member includes an upper surface adapted substantially to match the configuration of the bottom surface of the shoe body so as to fit closely therewith. The sole member further includes a lower or bottom surface spaced from its upper surface. A textured sole pattern is formed on the lower surface and has a tread or non-skid traction surface.

A first angle portion is formed in the sole member, extending from the heel of the shoe body downwardly at a slight slope of between approximately 4°–30° to a point vertically under the instep of the shoe body. The sole in the first angle portion expands outwardly from the heel, projecting from the sides of the shoe body. A second angle portion is formed below the toe of the exercise shoe. The second angle portion slopes downwardly from the front end of the exercise shoe at an angle that is substantially greater than the slope of the first angle portion, and the sole in the second angle portion also expands outwardly along its length.

An elevated platform is formed on the sole member between the first and second angle portions. The elevated platform is of a desired thickness corresponding to the desired degree of difficulty of use of the exercise shoe as the thicker the platform, the greater the stress placed on the foot of the wearer during use. The platform further has a relatively. short length in relation to the length of the first and second angle portions, approximately equivalent to the length of the ball portion of the wearer's foot and has a substantially flat lower surface. The sole member further includes side flanges or portions that project from the sides of the shoe body laterally, overlapping the sides of the shoe body by approximately one-half to two inches at the elevated platform, although greater widths can be used as desired, in order to create a stable platform for the shoe. The width of the sole member is dependent upon the thickness of the sole member and thus the height of the exercise shoe such that as the thickness of the sole member is increased, increasing the height of the exercise shoe, the width of the sole member is accordingly increased to provide stability and prevent the shoe from twisting or rolling laterally.

A first pivot point is formed between the elevated platform and the first angle portion along a first plane substantially bisecting the foot of the wearer between the instep region at the front of the leg and the ball of the wearer's foot, in the front edge of the instep of the foot lies a second pivot point formed between the platform and the second angle portion along the joints between the toes and the ball of the wearer's foot at the front end of the ball of the foot. The shoe, and thus the foot of the wearer, tends to pivot or roll about the pivot points during the normal walking motion of the wearer or during exercising.

When walking, the wearer tends to touch the heel of the shoe down in a first position, with the first angled portion of the sole member engaging the ground or walking surface. As the weight of the wearer is shifted forwardly as part of the walking motion, the shoe pivots about the first pivot point between the first angle section and the elevated platform, which tends to roll the foot and leg of the wearer forwardly so as to redistribute the weight of the wearer. When the wearer raises forward to complete the stride, the shoe pivots further forwardly about the second pivot point formed approximately beneath the ball of the foot of the wearer to raise the heel of the wearer's foot. The short length of the platform of the shoe tends to urge the wearer forward so that a smooth rolling motion is produced to ensure the stretching and stressing of the foot for the exercising thereof and to prevent the wearer from walking "flat-looted."

Such a motion produces more complete muscle, ligament, and tendon stretching, contracting, and toning, and tends to stretch and strengthen muscles, ligaments, and tendons not ordinarily worked or stretched during a normal walking motion. This motion further tends to insure that the foot and leg of the wearer are maintained in the proper alignment to correct the foot position or stride of the wearer during walking. Such a benefit is especially important in training or retraining atrophied muscles, or the muscles, ligaments, and tendons of handicapped persons to assume naturally a position or alignment for a normal walking motion. As a result, the muscles, ligaments, and tendons of the legs, feet, hips, and back of the wearer are exercised, strengthened, and trained with minimal impact on the joints and spine.

Various objects and advantages of the present invention will become apparent to those skilled in the art upon a reading of the following detail description when taken in conjunction with the accompanying drawings.

DETAILED DESCRIPTION OF THE PREFERRED EMBODIMENT

Figure 1:
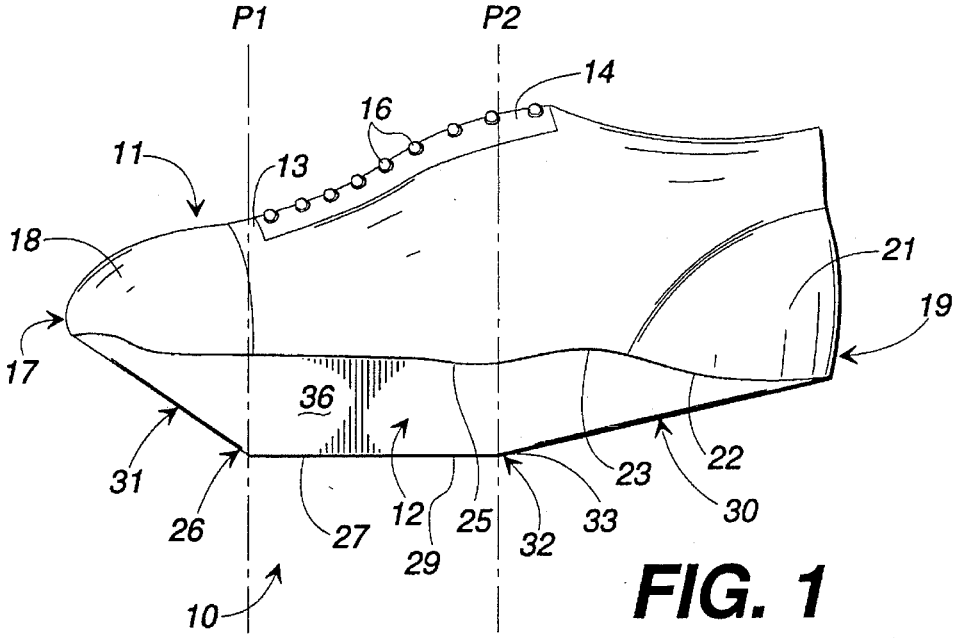
FIG. 1 is a side elevational view of the exercise shoe.

Referring now to the drawings in greater detail in which like numerals indicate like parts throughout the several views, FIG. 1 illustrates an exercise shoe 10 for use in exercising, strengthening, and rehabilitating the muscles, tendons, and ligaments for the feet, ankles, and legs of a wearer. The exercise shoe 10 includes a shoe body 11 and a sole member 12 attached to the shoe body. The shoe body 11 generally is formed from canvas, leather, cloth, or other materials typically used for athletic shoes and is of a conventional athletic shoe design. It will be understood that while the exercise shoe of the present invention is shown as a low-cut tennis shoe type of shoe, the shoe body can be of any conventional type of shoe design, including high-top or oxford-type shoes.

Figure 3B:
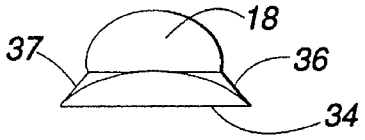
FIG. 3B is an end view of the exercise show illustrating the lateral projections of the sole member on each side of the shoe.
Figure 2:
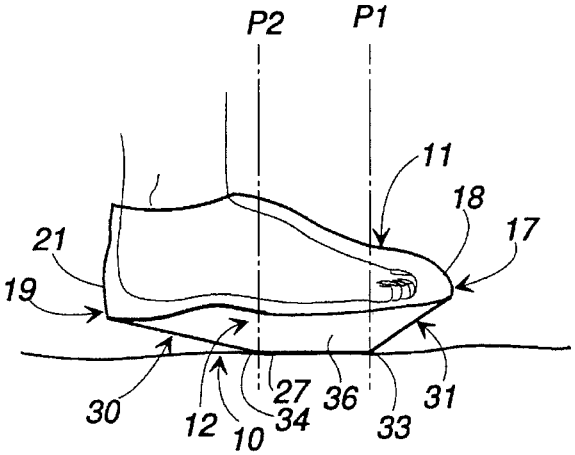
FIG. 2 is a side elevational view schematically illustrating the foot of a wearer within the exercise shoe.
Figure 3A:
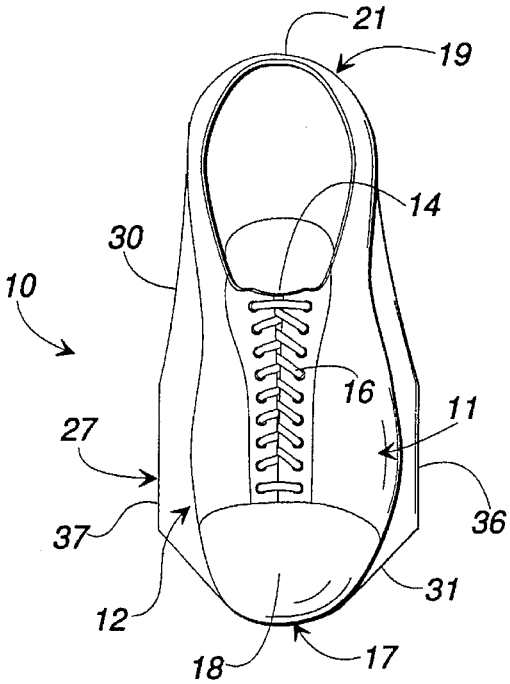
FIG. 3A is a top plan view of the exercise shoe illustrating the lateral projection of the platform section of the sole member on each side of the shoe.

As illustrated in FIGS. 1, 2, and 3, the shoe body is approximately sized to receive and cover the foot of a wearer, and thus the shoe body will be formed in a variety of shoe sizes. The shoe body includes a shoe upper 13 (FIGS. 1 and 3), a tongue 14, and a series of lacings 16 threaded across the shoe upper over the tongue 14 for securing the exercise shoe onto the foot of the wearer. The shoe body (FIGS. 1 and 3) further includes a first or front end 17 at which is formed a toe portion 18 of the exercise shoe, and a second or rear end 19, at which is formed the heel 21 of the shoe, and a bottom portion or surface 22. The bottom portion or surface of the shoe body is attached to the shoe upper 13 and extends longitudinally along the length of the shoe body between the front end 17 and rear end 19. As indicated in FIG. 2, the bottom surface generally is configured so as substantially to fit the contour of the foot of the wearer, and includes an arched instep 23 formed therein adjacent the heel 21 of the exercise shoe and beneath the instep of the foot of the wearer. The construction of the shoe body thus is similar to conventional athletic shoes, designed to fit comfortably the foot of a wearer.

As shown in FIG. 1, the sole member 12 is attached to the bottom surface 22 of the shoe body 11, and extends from the rear end 19 along the length of the exercise shoe 10 to the front end 17 of the shoe. The sole member generally is formed from a substantially rigid material such as a hard plastic or rubber in order to provide sufficient arch support for the wearer's foot. It will, however, be understood that the sole member also can be formed from a softer, compressible material, such as a foam rubber or similar material, with an aluminum shank inserted between the sole member and the bottom surface of the shoe body to provide arch support. As will be discussed more fully hereinafter, the sole member varies in thickness along its length, with its thickness dependent upon the desired height of the exercise shoe.

The sole member 12 includes an upper surface 25 and a lower, ground engaging surface 26. The upper surface 25 has approximately the same configuration as that of the bottom surface 22 of the shoe body 11 so as to substantially match the contour of the bottom surface of the shoe body and attaches to the bottom surface 22 by adhesive or similar means in order to attach the sole member to the shoe body. The lower or bottom surface 26 of the sole member generally is covered with a ground contacting sole 27, generally comprised of a soft rubber having a tread or traction design formed therein. The sole 27 thus provides the exercise shoe with a non-skid surface to prevent the exercise shoe from slipping or sliding as the wearer walks.

As FIG. 1 illustrates, a first angle portion 30 is formed in the sole member, extending between the heel 21 and the instep 23 of the shoe body 11. The first angle portion 30 extends from the rear end of the shoe body approximately to a first plane P1 in which the rear edge of the instep lies and expands laterally outwardly, projecting from the sides of the shoe body. The first angle portion further gradually slopes downwardly from the heel at an angle of between approximately 4°–30°, which angle depends upon the thickness of the sole member. The greater the thickness of the sole member, the greater the angle or slope of the first angle portion.

A second angle portion 31 is formed in the sole member 12, extending approximately along the toe portion 18 of the shoe body 11. As illustrated in FIGS. 1 and 2, the second angle portion extends downwardly from the first or front end 17 of the shoe body at an angle that is substantially greater than the angle or slope of the first angle portion 30. The second angle portion extends approximately the length of the toe portion of the shoe body, terminating approximately parallel to the joints between the foot (FIG. 2) and toes at a second plane P2 which extends approximately through the joints between the toes and the ball of the foot of the wearer, as FIG. 2 illustrates and expands laterally outwardly along its length.

Figure 4A:
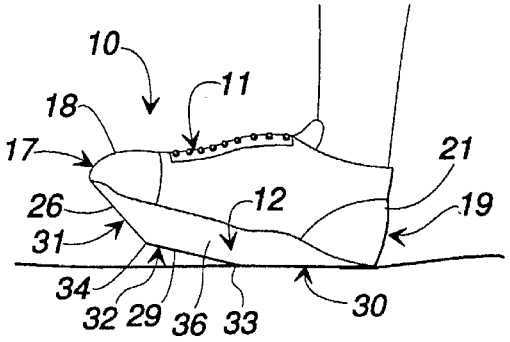
FIGS. 4A–4C illustrate the pivotal movement of the exercise shoe during the normal walking motion of a wearer.

As shown in FIG. 1, FIGS. 1 and 2, a platform section 32 is formed in the sole member 12 extending between the first angle portion and the second angle portion by a flat surface 29, located approximately under the ball B (FIG. 2) of the foot of a wearer. The platform section is of a desired thickness, depending on the desired elevation of the exercise shoe but has a shortened length in relation to the length of the first and second angle portions. A first pivot point 33 is formed between the first angle portion and the platform section 32 at the plane P1 between the first angle portion and the platform section 32. As shown in FIG. 4A, as the wearer walks or strides normally with the heel engaging the ground first, the exercise shoe and thus the foot of the wearer tends to be pivoted about the first pivot point into a position shown in FIG. 4B, causing a first series or set of muscles, tendons, and ligaments of the leg, foot, hip, and lower back of the wearer to be stretched and stressed to exercise such muscles, tendons, and ligaments. As a further result, the foot and leg of the wearer are aligned in the proper or correct foot position for a normal walking stride in order to train the muscles and tendons of the leg and foot of the wearer to become naturally aligned when walking.

A second pivot point 34 is formed between the platform section 32 and the second angle portion 31 at the plane P2 between the platform section and the second angle portion, approximately underlying the joint between the ball of the wearer's foot and the toes of the wearer's foot. As the weight of the wearer is shifted further forwardly, the exercise shoe, and thus the wearer's foot pivots about the second pivot point which stresses the remaining or a second series of muscles, ligaments, and tendons of the foot, leg, hip, and lower back in an opposite manner from the motion of the wearer's foot being pivoted around the first pivot point. As a result, the muscles, ligaments, and tendons of the feet, legs, hips, and lower backs of wearers are substantially equally stressed in order to exercise and thus strengthen the muscles, ligaments, and tendons.

Additionally, as FIG. 3B illustrates, the platform generally is of a greater width than that of the shoe body, having side portions 36 and 37 project laterally from and overlap the sides of the shoe body. The side portions 36 and 37 extend between the ends of the first and second angle portions, between the first and second pivot points 33 and 34. The side portions generally extend outwardly from the sides of the exercise shoe by approximately ½ to 2 ½ inches, although it is possible for the side portions to extend laterally by greater or lesser distances, as a function of the thickness of the sole member and thus the height of the exercise shoe. Accordingly, the greater the height of the exercise shoe, the more the side portions 36 and 37 of the sole member extend outwardly from the sides of the shoe body. The side portions thus provide lateral stability to the exercise shoe to reduce the chance of the shoe pivoting or twisting to one side or the other due the shifting or redistribution of the weight of the wearer while walking.

Figure 5:
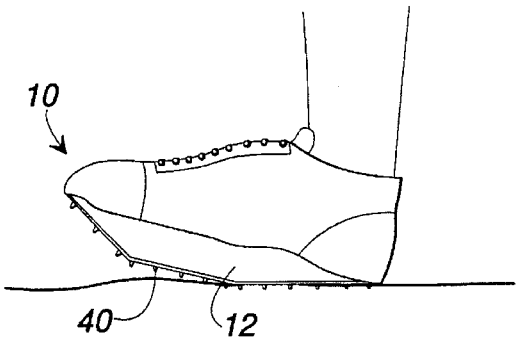
FIG. 5 illustrates an additional embodiment of the exercise shoe having a series of cleats attached to the bottom section of the sole member of the exercise shoe.

FIG. 5 illustrates an additional embodiment of the present exercise shoe in which the tacky, non-skid sole 27 on the bottom surface of the sole member 12 includes a series of spikes or cleats 40. The spikes or cleats provide enhanced traction when walking on soft or uneven ground.

USE OF THE EXERCISE SHOE

Figure 4C:
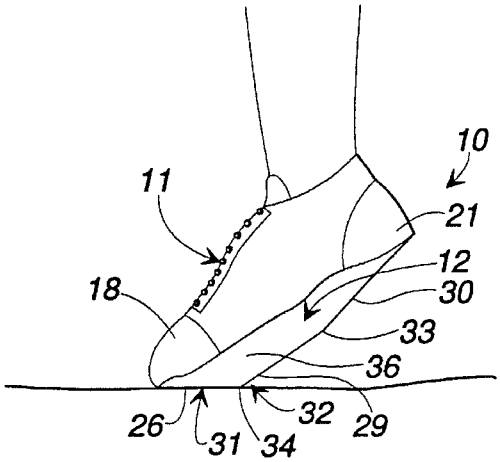
Figure 4B:
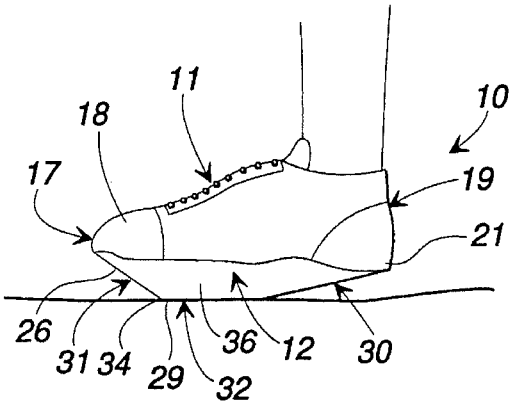

AS shown in FIGS. 4A–4C, during walking or striding, the exercise shoe tends to manipulate and cause the foot of the wearer to be placed in desired positions for stretching and strengthening the muscles, ligaments, and tendons of the foot, leg, hip, and lower back of a wearer. In a first position shown in FIG. 4A, the foot of the wearer generally is slightly inclined, with the heel of the wearer bearing against the ground surface and the toe of the exercise shoe raised slightly above the heel. In this position, the wearer can be sitting, standing, or rotating to this position during a normal walking or striding motion.

With the wearer's foot in the first position as shown in FIG. 4A, a first series of muscles and ligaments of the wearer's foot are stretched and stressed. In the foot, the superior and inferior peroneal retinaculum, flexor halluces, longus, extensor digitorium brevis, adductor digiti minima, peroneus lertius, and plantar calcaneonavicular muscles and ligaments are stretched and are placed under stress so as to strengthen these muscles and ligaments. The stretching and strengthening of the plantar calcaneonavicular ligament is especially important for developing greater speed, agility, and jumping ability. In the calf, the gastrocnemius, soleus, plantarius, and peroneus brevis, flexor hallucenes, longus digitorium, tibialis posterior, tendo calcaneus, and the achilles tendon are all stretched and strengthened when the foot is in the initial position of FIG. 4A. Further, the thigh muscles including the vastus lateralis, biceps femoris, gracilis, semitendinosus, fascia lata, obturator internus, inferior gemellus, and iliacus muscles are stretched and stressed. Further, in the hip area of the wearer, the major muscle groups stretched and strengthened include the piriformis, superior gemellus, psoas major, and gluteus maximum, all of which are important for running, jumping, climbing stairs, and rising from a sitting to a standing position. The positioning of the foot and in the initial position shown in FIG. 4A further stretches the muscles of the lower back including the latissimus, the dorsi, lliocostalis, lumborum, obloquies, and thoracolumbar fascia. As a result, these muscles and ligaments are strengthened in order to increase spring and thus the speed and jumping ability of the wearer.

As the weight of the wearer is shifted forwardly during a normal walking or striding motion, as shown in FIG. 4B, the foot of the wearer pivots about the first pivot point 33, raising the heel of the foot as the wearer moves into an upright standing position with the platform section 32 engaging and resting flush with the ground. This pivoting movement tends to reorient the foot and redistribute the weight of the wearer, causing the stretched muscles, ligaments, and tendons of the foot, leg, hip, and lower back of the wearer to contract and places stress on an additional series of muscles, etc. The contraction of such muscles provides additional stretching and exercising of the muscles, ligaments, and tendons.

The short length of the platform section 32 naturally tends to urge the front of the wearer forward so that the wearer's foot moves in a natural forwardly pivoting motion. The overlapping side portions 36 and 37 of the heel stabilize the wearer's foot and prevent the wearer's foot from twisting or rolling laterally, causing injury. As a result, the foot of the wearer becomes correctly aligned or positioned with respect to the leg of the wearer as the wearer moves from the first foot position of FIG. 4A through an upright standing position as shown in FIG. 4B to a forward leaning second foot position shown in FIG. 4C during a normal walking motion. This causes the foot to be trained to naturally move into proper alignment with the leg of the wearer during a normal walking or striding motion.

As shown in FIG. 4C, as the weight shift continues, the foot of the wearer is rotated forwardly, about the second pivot point 34 into the second foot position shown in FIG. 4C, as the weight of the wearer is shifted further forwardly. As the foot is rotated about the second pivot point, the wearer's heel is raised as the toe of the exercise shoe engages the ground. This stresses and stretches the remaining series of muscles, ligaments, and tendons of the foot, calf, knee, thigh, hip, and lower back of the wearer so that all of the muscles, ligaments, and tendons of the foot, leg, hip, and lower back of the wearer are stressed and thus strengthened equally.

With the wearer's foot in the second foot position as illustrated in FIG. 4C, the muscles and ligaments of the foot are again stressed and thus strengthened, which muscles include the superior and inferior extensor retinaculum, extensor digitorum longus, extensor halluces, tibialis, anterior and peroneus tertius. In the calf of the leg, the extensor digitorum longus, tibialis anterior, peroneus longus, an extensor halluces longus, which muscles extend through the foot, are also stretched through the calf of the leg. The patella ligaments and the tibialis collateral ligaments of the knee are also stretched and strengthened as the foot moves into the second foot position. Further, the muscles in the hip area, including the tensor fascial latal, adductor longus, gluteus medius, and minimis are exercised and thus strengthened, which provide balance for walking, posture, etc., and supports the weight of the wearer when walking with one foot lifted so as to keep the spine, etc., from tilting or becoming misaligned.

As a result, the muscles stretched in the first foot position illustrated in FIG. 4A are stretched beyond normal exercising without high impact, creating greater dexterity as well as greater strength through all ranges of motion. The muscles stretched in the second foot position further increases the effect of the first foot position so as to enhance and increase the speed, quickness, and jumping ability of the wearer. Further, the corrective positioning effect of the shoe forces the wearer to use lazy or atrophied or deformed/handicapped muscles, ligaments, etc. The feet and legs are thus forced and thus are trained to assume naturally a correct position or alignment to help overcome handicaps or walking disorders such as pigeon-toe and other walking disorders.

The present invention, therefore, is extremely beneficial in injury rehabilitation for a large number of foot, ankle, knee, leg, hip, and lower back injuries. The exercise shoe of the present invention also is extremely beneficial in rehabilitation therapy for the handicapped in helping handicapped persons, such as victims of palsy, walk with a more normal stride and/or without the necessity of corrective aids or walkers, etc.

While the present invention has been described in detail with reference to a preferred embodiment, it will be understood by those skilled in the art that numerous modifications, additions, and changes can be made thereto without departing from the spirit and scope of the invention.

I claim:

1. An exercise shoe for the strengthening the muscles, tendons, and ligaments of a leg and foot of a wearer, comprising a shoe body including an opening to receive the foot of the wearer, a bottom portion, a heel formed at one end of said shoe body, a toe formed at an opposite end of said shoe body, and an instep portion intermediate said toe and said opening; and a substantial sole member mounted to said bottom portion of said shoe body and having a first angle section extending downwardly from said heel to a position vertically under said instep portion of said shoe body at an angle and expanding laterally outwardly, a platform portion having a substantially flat ground engaging surface extending from said first angle section toward said toe, and a second angle section intersecting said platform portion opposite said first angle section, extending upwardly from said platform portion to said toe of said shoe body at an angle having a slope substantially greater than the slope of said first angle section , with said platform portion having a predetermined thickness, a width greater than said shoe body so as to extend laterally beyond said bottom portion to stabilize the shoe against lateral and rotational movement and having a shortened length less than the length of said second angle section such that the shoe tends to pivot forwardly naturally to prevent the wearer from walking flat footed;

whereby as the wearer walks, the weight of the wearer is shifted and redistributed so that the foot of the wearer is forced to pivot forwardly and to become aligned with the leg of the wearer and the muscles, tendons, and ligaments of the leg are exercised and subjected to stresses to strengthen and train the muscles, ligaments, and tendons.

2. The exercise shoe of claim 1 and wherein said sole member includes a bottom surface spaced from said bottom portion of said shoe body and having a tread formed therein.

3. The exercise shoe of claim 1 and wherein said sole member is formed from a substantially rigid plastic material.

4. The exercise shoe of claim 1 and wherein said platform laterally overlaps said shoe body on opposite sides thereof by between ½ to 2½ inches.

5. The exercise shoe of claim 2 and further including a plurality of cleats attached to said bottom surface of said sole member.

* * * * *